US008950333B2

(12) United States Patent
Burczynski et al.

(10) Patent No.: US 8,950,333 B2
(45) Date of Patent: Feb. 10, 2015

(54) MULTI-COMPONENT BULLET WITH CORE RETENTION FEATURE AND METHOD OF MANUFACTURING THE BULLET

(71) Applicant: RA Brands, L.L.C., Madison, NC (US)

(72) Inventors: Thomas J. Burczynski, Montour Falls, NY (US); Jason Imhoff, North Little Rock, AR (US)

(73) Assignee: RA Brands, L.L.C., Madison, NC (US)

( * ) Notice: Subject to any disclaimer, the term of this patent is extended or adjusted under 35 U.S.C. 154(b) by 192 days.

(21) Appl. No.: 13/748,841

(22) Filed: Jan. 24, 2013

(65) Prior Publication Data

US 2014/0311372 A1 Oct. 23, 2014

Related U.S. Application Data

(63) Continuation-in-part of application No. 13/190,972, filed on Jul. 26, 2011, now Pat. No. 8,752,484.

(51) Int. Cl.
*F42B 10/00* (2006.01)
*F42B 12/34* (2006.01)
(Continued)

(52) U.S. Cl.
CPC ..... *F42B 12/34* (2013.01); *F42B 14/00* (2013.01); *F42B 33/00* (2013.01)
USPC ..... 102/507; 102/508; 102/517

(58) Field of Classification Search
CPC ..... F42B 12/34; F42B 12/76; F42B 12/78
USPC ..... 102/507, 508, 517
See application file for complete search history.

(56) References Cited

U.S. PATENT DOCUMENTS 1,081,616 A 12/1913 Johnson
2,696,130 A 12/1954 Peters
(Continued)

FOREIGN PATENT DOCUMENTS

DE 648039 C 7/1937
DE 705504 C 4/1941
(Continued)

OTHER PUBLICATIONS

International Search Report dated Apr. 17, 2014 for International Application No. PCT/US2014/012952 filed Jan. 24, 2014.
(Continued)

*Primary Examiner* — J. Woodrow Eldred
(74) *Attorney, Agent, or Firm* — Womble Carlyle Sandridge & Rice, LLP

(57) ABSTRACT

A three component bullet with an improved core retention feature and a method of manufacturing the bullet includes a cylindrical jacket having an open end and a closed end containing a malleable metal core which is forced into a forming die having a bottleneck shaped interior, wherein the outside diameter of the open-ended forward portion of the jacket is smaller than the outside diameter of its closed rearward portion. The open end of the pre-form may be dropped through or forced through a malleable non-rigid locking band. A relatively tight-fitting punch enters the open end of the pre-form, to radially swell the core and subsequently portions of the jacket fore and aft of the non-rigid locking band, thereby securing the non-rigid locking band in place. An inwardly-extending annular band of jacket material embeds itself into the core material to lock the core inside the jacket.

17 Claims, 12 Drawing Sheets

(51) Int. Cl.
*F42B 14/00* (2006.01)
*F42B 33/00* (2006.01)

(56) References Cited

U.S. PATENT DOCUMENTS

| | | | | |
|---|---|---|---|---|
| 3,881,421 | A | 5/1975 | Burczynski | |
| 4,108,073 | A | 8/1978 | Davis | |
| 4,550,662 | A | 11/1985 | Burczynski | |
| 4,947,755 | A | 8/1990 | Burczynski | |
| 5,385,100 | A | 1/1995 | Corzine et al. | |
| 5,385,101 | A | 1/1995 | Corzine et al. | |
| D389,221 | S | 1/1998 | Borg | |
| 5,943,749 | A | 8/1999 | Swank | |
| 6,213,022 | B1 | 4/2001 | Pullum | |
| D447,209 | S | 8/2001 | Benini | |
| 6,530,328 | B2 | 3/2003 | Burczynski et al. | |
| 6,776,101 | B1 | 8/2004 | Pickard | |
| 6,805,057 | B2 | 10/2004 | Carr et al. | |
| 7,503,260 | B2 * | 3/2009 | Kapeles | 102/502 |
| D621,468 | S | 8/2010 | Nilsson | |
| 7,874,253 | B2 | 1/2011 | Marx | |
| D646,179 | S | 10/2011 | Jansen | |
| 8,171,852 | B1 * | 5/2012 | Rebar | 102/510 |
| 8,186,277 | B1 * | 5/2012 | King | 102/507 |
| D664,042 | S | 7/2012 | Kurpis | |
| 8,256,352 | B2 | 9/2012 | Masinelli | |
| 8,397,641 | B1 | 3/2013 | Jackson | |
| 8,448,575 | B2 | 5/2013 | Goddard | |
| 8,511,233 | B2 | 8/2013 | Nilsson | |
| 8,640,589 | B2 | 2/2014 | Dryer et al. | |
| 8,646,389 | B2 | 2/2014 | Masinelli | |
| 8,752,484 | B2 * | 6/2014 | Burczynski | 102/439 |
| 8,763,535 | B2 | 7/2014 | Padgett | |
| 8,789,470 | B2 | 7/2014 | Frank | |
| 2006/0027128 | A1 | 2/2006 | Hober | |
| 2009/0288572 | A1 * | 11/2009 | Sauvestre | 102/439 |
| 2013/0305950 | A1 | 11/2013 | Coffman, II | |
| 2014/0261044 | A1 | 9/2014 | Seecamp | |

FOREIGN PATENT DOCUMENTS

| | | | |
|---|---|---|---|
| DE | 743914 | C | 1/1944 |
| DE | 2064553 | A1 | 7/1972 |
| EP | 0225532 | A1 | 6/1987 |
| EP | 0918208 | A1 | 5/1999 |
| GB | 191300326 | A | 1/1914 |
| WO | WO/2013/016330 | | 1/2013 |

OTHER PUBLICATIONS

Written Opinion dated Apr. 17, 2014 for International Application No. PCT/US2014/012952 filed Jan. 24, 2014.

International Search Report for PCT/US2012/047966 dated Oct. 16, 2012.

Written Opinion for PCT/US2012/047966 dated Oct. 16, 2012.

George C. Lambert, letter to Mr. C. V. Bracher regarding "Belted Bullet", Mar. 4, 1936, 2 pages, Peters Cartridge Division of Remington Arms Co., Inc., Bridgeport, CT.

Maj. George Nonte, Tip to Tip, Handloader: The Journal of Ammunition Reloading, Jul.-Aug. 1976, pages cover, 4, 12-13, Issue 62, Wolfe Publishing Company, Inc., Prescott, AZ.

Don Roberts, At Last! Pressure Data for the .30-40 Krag, Handloader: The Journal of Ammunition Reloading, Jul.-Aug. 1976, pages cover, 4, 38-41, Issuer 62, Wolfe Publishing Company, Inc., Prescott, AZ.

Photograph of .30 U.S. Govt. 1906—180 GRA . . . ; Scientific Bullet Design Ins . . . Superfine Accuracy; and Heavy Jacket Re-Inforced by Belt.

Sharpe, Philp Burdette, "Complete Guide to Handloading", pp. 41-43, third edition, Wolfe Pub Co.; 1988.

* cited by examiner

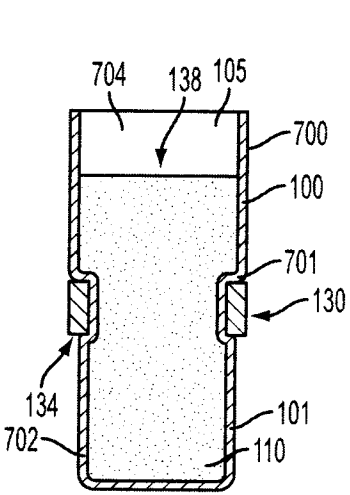
FIG. 20A
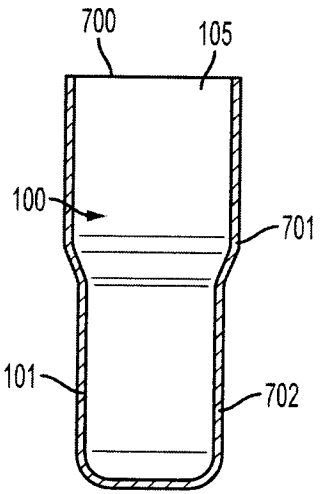
FIG. 20B
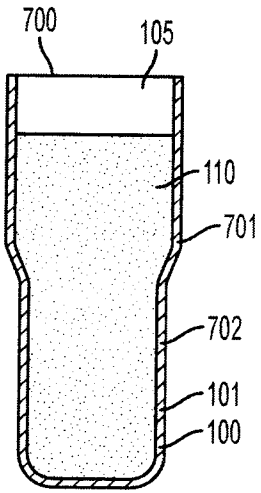
FIG. 20C
FIG. 20D

MULTI-COMPONENT BULLET WITH CORE RETENTION FEATURE AND METHOD OF MANUFACTURING THE BULLET

CROSS-REFERENCE TO RELATED APPLICATION

This application is a continuation-in-part of U.S. patent application Ser. No. 13/190,972, filed Jul. 26, 2011, which is entirely incorporated by reference herein.

1.0 FIELD OF THE DISCLOSURE

This disclosure relates generally to a jacketed bullet which utilizes a core-retaining feature within the jacket and a method of making the bullet and, more specifically, this disclosure relates to a three component bullet having an external locking band which ultimately forms a core-locking feature within the interior of the jacket such that the core remains locked within the jacket even after impact with a hard barrier material such as windshield glass or sheet steel, for example.

2.0 RELATED ART

In order for a bullet to achieve optimum terminal performance, its jacket and core must penetrate a target as a single unit and remain connected throughout the course of travel, regardless of the resistance offered by the target material.

Various attempts have been made over the years to keep a bullet's jacket and core coupled together on impact. One of the earliest and simplest attempts utilized a knurling method which created a "cannelure" in a jacketed bullet. A cannelure typically includes a narrow, 360° circumferential depression in the shank portion of the bullet jacket. While the cannelure was originally conceived for use as a crimping feature, various companies have attempted to use it as both a crimping groove and as a core retaining feature, or solely as a core retaining feature. The knurling process forces jacket material radially inwardly, subsequently creating a shallow internal protrusion which extends a short distance into the bullet core. This approach has generally proven ineffective in keeping the core and jacket together, primarily due to the limited radial depth involved and the minimal amount of longitudinal core-gripping area that a cannelure offers. Upon impact with a hard barrier material, the core tends to immediately extrude beyond the confines of the inner protrusion, subsequently sliding out of the jacket. Depending on jacket wall thickness, core hardness and impact energy, axial core movement can actually "iron out" the internal geometry of the cannelure as the core slides forward. Even multiple cannelures have proven ineffective due to the inadequate amount of square area they are collectively able to cover.

U.S. Pat. No. 4,336,756 (Schreiber) describes a "two-component bullet" intended for hunting which comprises a cold worked jacket utilizing a narrow, inwardly-extending annular ring of jacket material terminating in a "knife-like edge" which is formed from a thickened portion of the jacket wall and which engages and holds the base of the core within the jacket after the bullet is final formed. U.S. Pat. No. 4,856,160 (Habbe, et al.) also describes a "two-component bullet" utilizing a reverse taper on the rearward interior of the jacket to lock the core within the jacket.

Other attempts at retaining the core within the jacket have been used in the past which do not utilize an external locking band. Such attempts range from providing a "partition" separating a rear core from a front core, electroplating a copper skin around the core prior to final forming the bullet, and heat-bonding (or similar heat treatment) the core to the interior of the jacket wall after the bullet is final formed. Each of these methods has shortcomings. The shortcomings typically include one or more of the following: (a) Jacket-core eccentricity resulting in less than desirable accuracy due to bullet imbalance, (b) slow manufacture, (c) high cost, and/or (d) less reliable.

With respect to the use of an external "band" in the construction of a projectile, U.S. Pat. No. 4,108,073 (Davis) describes an armor piercing projectile having a "rotating band" which is positioned around the outer surface of the jacket near the rearward end of the projectile. The diameter of the rotating band is larger than the diameter of the jacket. The rotating band serves to impart rotation to the projectile as it passes through the gun bore and seals hot gasses within the bore. The band typically includes plastic, gilding metal, sintered iron or other well known rotating band material. The Davis patent as cited herein should be viewed as general information only as the rotating band concept serves a completely different purpose than the three-component invention disclosed herein.

SUMMARY OF THE INVENTION

According to an aspect of the disclosure, a bullet is described, which contains a malleable core having a section with a first end and a second end. A jacket with a first end and a second end surrounds the malleable core. A non-rigid locking band surrounds a portion of the jacket and is configured to retain the malleable core with the jacket upon firing of the bullet. At least a portion of the non-rigid locking band is configured around a circumferential depression in a wall of the jacket and around a mating circumferential depression in the malleable core, which depression defines a hinge area to facilitate and help control expansion of an ogive portion of the bullet upon impact. The band generally is of a lightweight material, such as a polymer material, and is capable of withstanding pressures and high temperatures generated upon firing the bullet, and further can break away, stretch or otherwise become dislodged from the circumferential depression on impact of the bullet.

According to another aspect of the disclosure, a method of manufacturing a bullet is described. In one embodiment, a jacket can be filled with malleable core material to generally form the bullet. Thereafter, a circumferential depression is formed extending around the circumference of the jacket inwardly. As a result a hinge or expansion control area is defined below an ogive portion of the bullet. A non-rigid band is positioned in the depression formed around the circumference of the jacket. The jacket and the malleable core material are retained together during firing by the non-rigid band positioned within the depression around the circumference of the jacket, without affecting travel of the bullet along a firearm bore or its flight. Upon impact, the band can break away or otherwise become dislodged from the circumferential groove to expose the hinge whereupon the expansion of the bullet is facilitated by the hinge area about which at least a portion of the bullet can be folded generally outwardly and rearwardly while encountering reduced resistance, and without weakening the jacket.

Additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the invention, are incorporated in and constitute a part of this specification, illustrate embodiments of the invention, and together with the detailed description, serve to explain the principles of the invention. No attempt is made to show structural details of the invention in more detail than may be necessary for a fundamental understanding of the invention and the various ways in which it may be practiced. In the drawings:

FIGS. 20A-20G sequentially illustrate another embodiment of a method of manufacturing a bullet according to the principles of the present invention.

DETAILED DESCRIPTION OF THE DISCLOSURE

Figure 4:
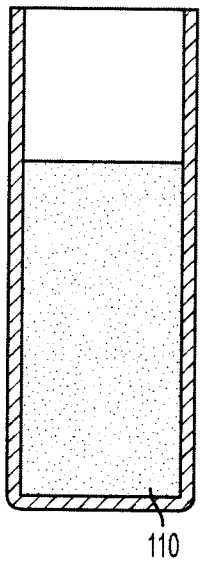
FIG. 4 is an exemplary illustration showing the cylindrical jacket with seated core of FIG. 3, after the seating punch has fully retracted.

The aspects of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

It is understood that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural reference unless the context clearly dictates otherwise. Unless defined otherwise, all technical and scientific terms used herein have the same meanings as commonly understood by one of ordinary skill in the art to which this invention belongs.

FIGS. 1-20G generally illustrate various embodiments of the invention directed to a multi-component bullet (shown at 160 in FIG. 11) with core retention feature 165. In one example embodiment, the multi-component bullet 160 includes a metal jacket 100, a malleable core 110 and an externally situated, non-rigid locking band, shown at 130, which is embedded in a portion of the outside of the jacket. In one embodiment illustrated in FIGS. 1-11, the non-rigid locking band can be swaged in place to form an inward circumferential protrusion or depression 134 on the interior wall of the jacket, defining a hinge area or expansion control feature 175, and which embeds itself in the malleable core and locks the core within the jacket. The jacket and core remain locked together, even after the bullet is fired from a firearm and impacts hard barrier materials such as windshield glass, sheet steel, or the like, whereupon the band can separate or move away from the circumferential depression, facilitating expansion of the bullet in front of the hinge area, while retaining a large percentage of its original weight. This combination of elements allows the bullet to achieve post-barrier penetration of ballistic gelatin which exceeds 12 inches—the minimum depth called for in the FBI's Ballistic Test Protocol. In so doing, the bullet exhibits a terminally effective degree of expansion beyond its original diameter.

FIGS. 1-11 herein may be viewed as an overall sequence describing a first exemplary process performed according to embodiments of the invention for manufacturing a three-component bullet. FIGS. 1-11 are each longitudinal cross-sectional views.

Figure 1:
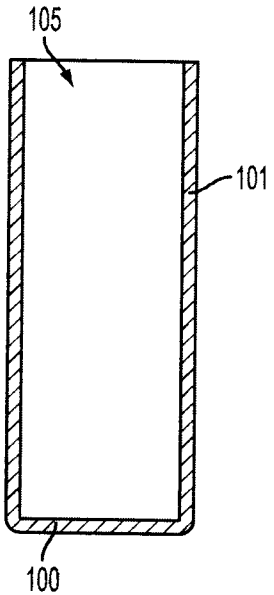
FIG. 1 is an exemplary illustration of an empty cylindrical metal jacket, configured according to embodiments of the invention.

FIG. 1 is an exemplary illustration of an empty cylindrical metal jacket, configured according to embodiments of the invention, generally denoted by reference numeral 100. The cylindrical metal jacket may be drawn from a metal cup and trimmed to an appropriate length, and having an open end 105. The jacket 100 may be made from any suitable malleable material. The preferred materials are brass, gilding metal, copper and mild steel. The jacket 100 may be configured in size based on any intended caliber, such as .223, .243, .30-06, .357, .38, .40, .44, or 9 mm, for example only. However, nearly any caliber bullet may be produced using embodiments of the invention.

Figure 2:
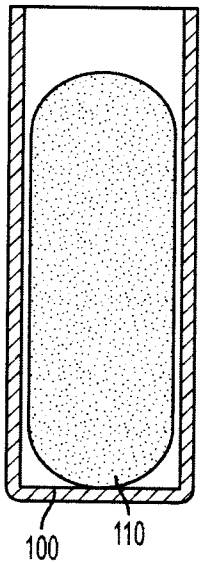
FIG. 2 is an exemplary illustration showing a malleable core which has been dropped into the cylindrical jacket shown in FIG. 1.

FIG. 2 is an exemplary illustration showing a malleable core which has been dropped into the cylindrical jacket shown in FIG. 1. At this point, the malleable core 110 is loose within the jacket 100. The malleable core 110 may be made from any suitable material. The preferred materials are pure lead and alloyed lead containing a percentage of antimony. Other materials are also contemplated by embodiments of the invention as will be understood by those skilled in the art.

Figure 3:
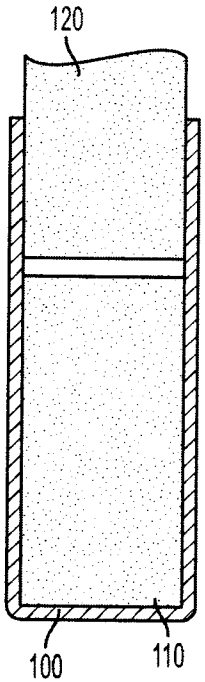
FIG. 3 is an exemplary illustration showing the cylindrical jacket and core of FIG. 2 after a seating punch has forcefully seated the core within the jacket.

FIG. 3 is an exemplary illustration showing the cylindrical jacket 100 and malleable core 110 of FIG. 2 after a seating punch 120 has forcefully seated the malleable core 110 within the jacket 100. This may be accomplished if the jacket 100 and the malleable core 110 are held in a substantially cylindrical die (not shown). In FIG. 3, the seating force has caused the malleable core 110 to shorten axially and expand radially. At this juncture, bottom and side surfaces of the malleable core 110 are in intimate contact with the interior wall of the jacket 100. The jacket 100 and malleable core 110 are securely coupled together and will remain so throughout the balance of the manufacturing steps. The seating punch 120 is shown retracting from the jacket 100 after having seated the malleable core 110 intimately with the jacket 100.

FIG. 4 is an exemplary illustration showing the cylindrical jacket 100 with seated malleable core 110 of FIG. 3, after the seating punch 120 has fully retracted.

Figure 5:
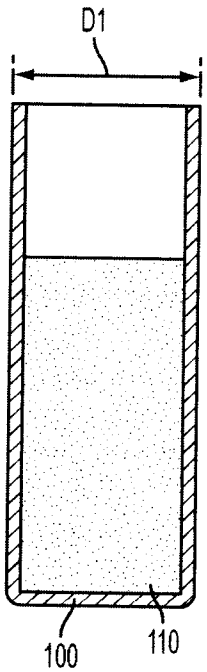
FIG. 5 is an exemplary illustration showing the cylindrical jacket with seated core of FIG. 4 (i.e., jacket/core assembly)

FIG. 5 is an exemplary illustration showing the cylindrical jacket 100 with seated malleable core 110 of FIG. 4 (i.e., jacket/core assembly). During this process the jacket 100 may be inverted, i.e., rotated 180° from its previous orientation in FIG. 4. However, it should be noted that the manufacture may be completed with any orientation. The diameter of the cylindrical jacket 100 is shown designated as D1 along its entire length at this stage.

Figure 6:
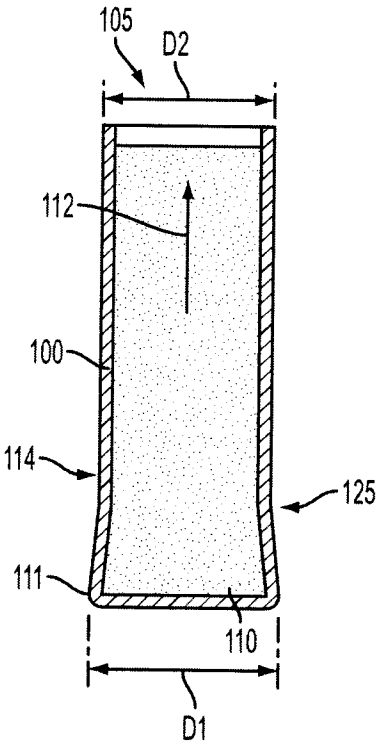
FIG. 6 is an exemplary illustration showing the jacket/core assembly of FIG. 5 after it has been forced into a bottleneck-shaped die (not shown) which has produced a bottleneck-shaped configuration.

FIG. 6 is an exemplary illustration showing the jacket-core assembly of FIG. 5 after it has been forced into a bottleneck-shaped die (not shown) which has produced a bottleneck-shaped configuration (hereafter, the "pre-form" 114). In an embodiment, the inward groove of the bottleneck-shaped configuration may have an axial height of approximately 0.075-0.125 inches. The openmouthed front end 105 of the pre-form 114 has been constricted inwardly along a length of the jacket 100, resulting in a smaller diameter D2 than the diameter D1 of its closed base end 111. The diameter at each opposite end of the pre-form 114 is connected by a transition angle which forms a tapered shoulder 125. It should be noted, however, that in lieu of a transition angle, the diameter of each end of the pre-form 114 can be connected by a radius. During the constriction process, the malleable core 110 is proportionally constricted as it is forced to assume the bottleneck-shaped geometry of the interior of the jacket wall. The subsequent volume reduction generally forces the malleable core 110 to flow in a direction represented by arrow 112, growing in length towards the open end 105 of the pre-form 114. The constriction action further tightens the seated malleable core 110 within the jacket 100. Moreover, the tapered shoulder 125 further acts to help lock the now expanded and re-formed malleable core 110 in-place proximate the base 111.

Figure 7:
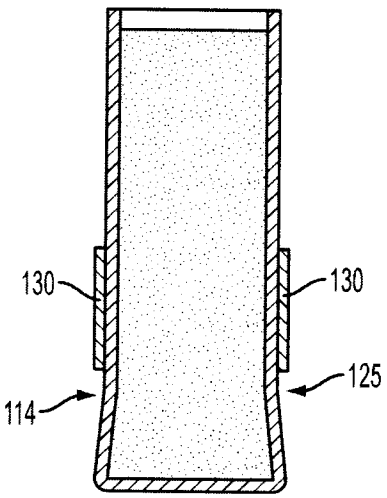
FIG. 7 is an exemplary illustration showing a non-rigid locking band of appropriate height, diameter and wall thickness, engaging the pre-form of FIG. 6.

FIG. 7 is an exemplary illustration showing a non-rigid locking band 130 of appropriate height, diameter and wall thickness, engaging the pre-form 114 of FIG. 6. Generally, the non-rigid locking band will be of a size and thickness, and formed from a material having a strength sufficient to support and help retain the core and jacket together upon firing and through at least initial impact of the bullet to achieve a desired level of penetration prior to expansion. In an embodiment, the non-rigid locking band 130 is constructed to have an axial wall height of between about 0.075 and 0.125 inches. The pre-form 114 and non-rigid locking band 130 may be transferred to another die station containing a substantially cylindrical die (not shown). The non-rigid locking band 130 may be fed under transfer fingers and the smaller, open end 105 of the pre-form 114 may be dropped through the non-rigid locking band 130. When shouldered opposition is employed, such as a metal sleeve, the momentum generated by a free-falling pre-form 114 is sufficient to axially position the non-rigid locking band 130 on the pre-form 114 with a high degree of accuracy from cycle to cycle.

The non-rigid locking band 130 may be constructed from a wide array of suitable materials that provide desired strength and support to the jacket and core during firing without adversely affecting the travel of the bullet along the barrel of a firearm or during flight, and is generally designed to break away, stretch and/or otherwise be dislodged from the circumferential depression 134 of the bullets formed according to the principles of the present invention to expose the hinge area 175. The non-rigid locking band material further will be selected to have a substantially high temperature resistance, for example, having a melting temperature of approximately 400° F.-450° F., or other temperature limit designed to withstand barrel temperatures generated upon firing of the bullet; and further preferably will have a resistance to chemicals used to lubricate and clean/preserve the finished bullets and the firearms in which they are used. The non-rigid locking band also needs to be light in weight in order to conform to certain U.S. Alcohol Tobacco and Firearms (ATF) requirements. For example, one requirement states that the weight of the bullet jacket cannot exceed 25% of the total bullet weight, or else it is considered to be an armor piercing bullet.

In one preferred embodiment, the non-rigid locking band 130 generally will comprise a plastic material, including various polymeric materials such as a filled or unfilled polymer comprising an amorphous thermoplastic or a semi-crystalline thermoplastic. For example, filled and unfilled polymers including polycarbonate, polyetherimide, poly ether ketone, poly phenylene sulfides and oxides, high density polyethylene, polystyrene, polyoxymethylene, and polyamide material, such as ULTEM™, PEEK™, Ryton™, Noryl™, Xarec™, Delrin® and Nylon® which have Rockwell M hardness values in a range of about 95 to about 114 can be used. Testing using locking bands formed from one of the above-cited groups demonstrated a robustness desired for cosmetic uniformity during manufacture, without cutting into or weakening the bullet jacket.

Other polymers also were considered for the non-rigid locking band 130, including polymers filled with a strengthening component, such as carbon fibers or fiberglass. For example, in one embodiment, the polymer non-rigid locking band 130 can contain approximately 20%-40% carbon fiber reinforcing material, and during testing of different locking band materials, it was found that a carbon filled polymer has a coefficient of friction that is about 36% lower than the coefficient of friction for the same fill percentage level of a fiberglass-filled polymer. However, when such locking band polymers are filled with a strengthening component, the filled polymer can be abrasive to the barrel and as a consequence, affect barrel wear. Thus, the use/level of a strengthening component should be balanced against projected wear or abrasiveness created thereby. Bands formed from one of the above-cited groups further have demonstrated a level of robustness needed for cosmetic uniformity during manufacture, without cutting into or weakening the bullet jacket. Table 1 below illustrates manufacturing results and observations made for locking bands formed from various polymer groups.

TABLE 1

| Band Material | Result |
|---|---|
| 30% carbon-filled (CF) PEEK | minimal feathering |
| 30% glass-filled (GF) ULTEM | minimal feathering |
| 20% GF Polycarbonate | noticeable feathering |
| 20% GF Delrin | noticeable feathering |
| 30% CF Xarec (as molded) | minimal feathering |
| 30% CF Xarec (baked) | minimal feathering |
| 30% GF Nylon 6 | some feathering |
| 20% GF Nylon 6 | noticeable feathering |
| 0% filled Polycarbonate | extreme feathering |
| 0% filled Nylon 6 | extreme feathering |
| 0% filled ABS | extreme feathering |
| 0% filled HDPE | extreme feathering |

The above results show that four band materials had minimal feathering, which is a desirable property. The 30% GF Nylon 6 had some feathering and the 20% GF Nylon 6 had more noticeable feathering. The 20% GF Polycarbonate and the 20% GF Delrin™ had noticeable feathering and lower brittleness. The 30% GF ULTEM™ had minimal feathering, but was slightly harder than PEEK™, making it a favorable band material. The 30% CF PEEK™ had minimal feathering and was less abrasive than ULTEM™, making it a particularly favorable band material.

In addition, the non-rigid locking band 130 also can contain a lubricant material. The lubricant can be an integral component of the polymer band material or can be added thereto. In a preferred embodiment, the non-rigid locking band 130 can contain approximately 0.25-5.0% lubricant.

Alternatively, it also will be understood the locking band 130 may be constructed from various other suitable materials. Of such other materials, preferred materials can include brass, gilding metal, copper and mild steel. The metal used in the locking band 130 does not have to match the metal used in the jacket 100. If the metal used is steel, the steel locking band may be electroplated to resist corrosion using a thin coating of copper, zinc, brass, nickel or any other corrosion-resistant material as desired. The locking band 130 may also be anodized, dyed or otherwise colored for marketing purposes or color-coded for law enforcement use to distinguish one type of ammunition from another.

Metal locking bands may be manufactured by drawing long metal jackets and thereafter pinch-trimming individual band sections from the jacket or by cutting off multiple band sections of the same on a lathe using a stepped cutoff tool. As an alternative, the locking bands can be cut from metal tubing using a lathe. The polymer material locking bands may be injection molded or cut to length on a lathe from tubing and applied in a press-fit arrangement, or can be wrapped about the jacket and compressed therewith as indicated in FIGS. 7-9.

The locking band 130 may be constructed to have an axial wall height of between about 0.075 of an inch and about 0.350 of an inch, with preferred heights for different caliber bullets varying, as indicated in FIGS. 13-19. For example, the locking band can have a height of about between about 0.075-0.125 inches for shorter rounds and/or between about 0.125 of an inch and 0.200 of an inch for some larger rounds. The locking band 130 further may be constructed to have a wall thickness of between about 0.009 of an inch and 0.045 of an inch, with a preferred wall thickness being between about 0.016 of an inch and 0.030 of an inch. The thickness of the locking band can further vary depending on the size of the bullet and the size of the circumferential depression 134 (FIG. 11) formed, but generally will be of a thickness such that an outer circumferential surface 136 of the locking band 130 generally will be substantially flush with or slightly recessed from the outer circumferential surface 101 of the bullet jacket and/or the core 110, as indicated in the Figures.

Figure 8:
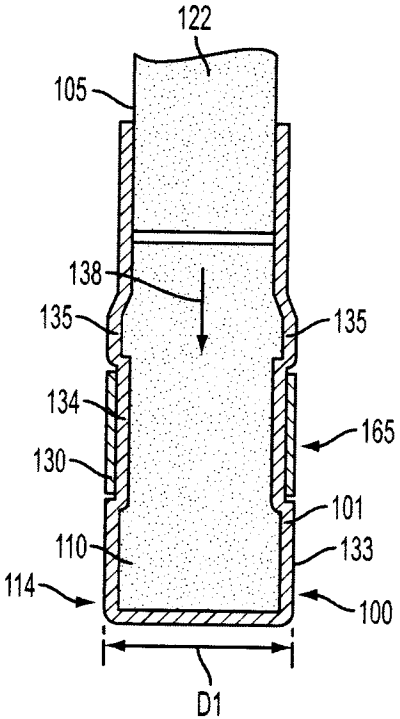
FIG. 8 is an exemplary illustration showing the pre-form and non-rigid locking band arrangement of FIG. 7, and the internal locking feature created on the interior of the jacket after a seating punch has radially expanded both the malleable core and the jacket sufficiently to create a pronounced shoulder area in the jacket fore and aft of the non-rigid locking band.

FIG. 8 is an exemplary illustration showing the pre-form 114 and the non-rigid locking band 130 arrangement of FIG. 7, and the internal locking feature created on the interior of the jacket 100 after a seating punch 122 has radially expanded both the malleable core 110 and the jacket 100 sufficiently to create a pronounced shoulder area in the jacket 100 fore and aft of the non-rigid locking band 130. In reference to FIG. 8, a relatively tight-fitting seating punch 122 has entered the open mouth 105 of the jacket 100 and generated sufficient axial force against the face of the malleable core 110 to radially swell the malleable core 110 and portions of the jacket 100 fore and aft of the non-rigid locking band 130. The non-rigid locking band 130 is secured in place while at the same time, an inwardly-extending annular band 134 of jacket material is produced, defining a circumferential protrusion about the jacket and core of the bullet, and which embeds itself into the malleable core material 110. This results in the malleable core 110 being locked inside the jacket 100. The malleable core 110 now may generally resemble an hourglass shape. During this seating-swelling process, sufficient pressure is generated to radially expand the jacket 100 and the malleable core 110 outwardly, with the result that the non-rigid locking band 130 and the jacket portions fore 135 and aft 133 of the non-rigid locking band 130 end up having substantially similar diameters. The seating punch 122 is shown retracting from the jacket 100 after having seated the malleable core 110. The core-seating step has decreased the axial length of the malleable core 110, represented by arrow 138, resulting in more "air space" at the open end 105 of the jacket 100. The additional room gained in this open end 105 area is usually needed for subsequent jacket-forming operations.

Figure 9:
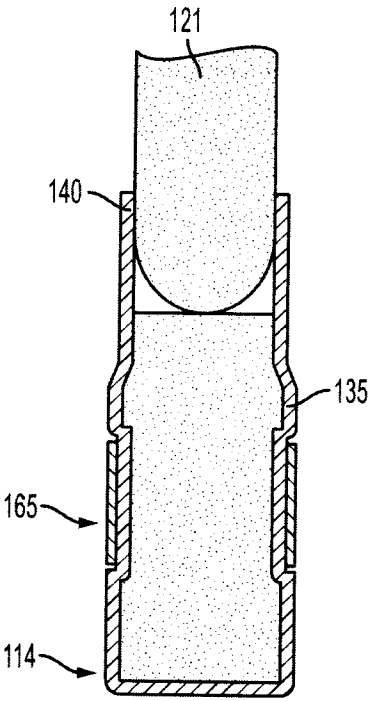
FIG. 9 is an illustration showing a belling punch entering and radially expanding the mouth of the pre-form shown in FIG. 8.

FIG. 9 is an illustration showing a belling punch 121 entering and radially expanding the mouth of the pre-form 114 shown in FIG. 8. The belling punch 121 may not contact or deform the malleable core 110 in any way. Belling 140 (or expanding) the jacket mouth (i.e., at open end 105) to near-caliber diameter is done to prepare the jacket mouth so that it can be weakened in a subsequent step using a standard-diameter nose-cut die, notching die, or scoring die, for example. However, it should be understood that a smaller diameter nose-cut die could be utilized, which would simplify the manufacturing procedure by eliminating the belling step shown in FIG. 9 altogether. This would allow one to go directly from the step represented by FIG. 8 to the step represented by FIG. 10 without materially affecting the cosmetic appearance of the final bullet.

Figure 10:
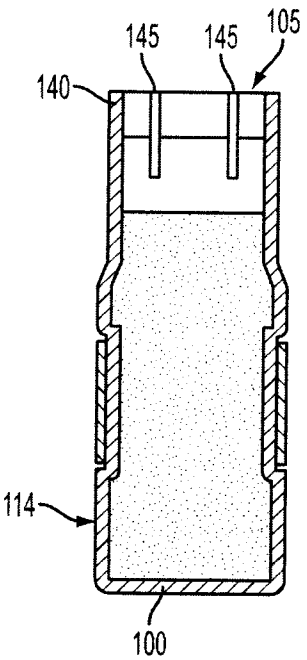
FIG. 10 is an exemplary illustration showing the pre-form of FIG. 9, after a nose-cut die (not shown) has configured jacket-weakening features in the jacket.

FIG. 10 is an exemplary illustration showing the pre-form 114 of FIG. 9, after a nose-cut die (not shown) has configured jacket-weakening features 145 in the jacket 100. It should be understood, however, that various jacket-weakening features 145 may be applied to the jacket mouth 105 at this station, which may include axially spaced slits, slanted slits, V-shaped notches, axial scores, and the like (or combinations thereof) in the mouth of the jacket 100. While a final bullet may be made without jacket-weakening features 145, it is desirable to include at least one of the jacket-weakening features 145 mentioned above to ensure consistent and reliable expansion over a wide range of velocities in various mediums. The jacket-weakening features 145 may form spaced petals.

In one aspect, the jacket-weakening features 145 may comprise a plurality of longitudinally projecting spaced slits 145 forming spaced petals there between, having side edges extending through a front open end of the malleable core 110 into a central recess to form petals of core material and jacket material between the spaced slits. The jacket material extends into the slits to said central recess, which permits the petals of malleable core and jacket material to separate and form outwardly projecting petals.

Figure 11:
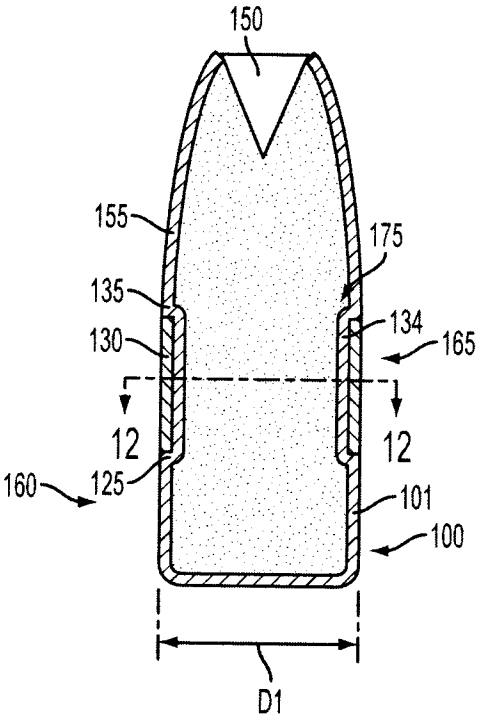
FIG. 11 is an exemplary illustration showing the pre-form of FIG. 10 after the pre-form is forced into a hollow point profile die.

FIG. 11 is an exemplary illustration showing the pre-form 114 of FIG. 10 after the pre-form 114 is forced into a hollow point profile die. The final form of the bullet 160 (i.e., a finished bullet) may or may not have a hollow point 150 in its nose, depending on desired features. Other nose features are possible. Regardless of its final nose configuration, the use of the present non-rigid locking band 130 feature and the formation of the bullet 160 results in a mechanical locking connection that retains the malleable core 110 within the jacket 100, substantially 100% of the time, but without interfering with the expansion of the bullet upon impact. The design of the bullet 160 further helps provide and facilitate a designed controlled and more consistent expansion of the ogive portion 155 of the bullet on a round-to-round basis. This occurs whether the bullet 160 impacts a hard barrier material such as windshield glass or metal, or a soft target, at a desired velocity, e.g., high velocity. It should be noted that, while the preferred location of the non-rigid locking band 130 is on the shank or bearing surface of the bullet 160 as shown in FIG. 11, the front portion of the non-rigid locking band 130 may, if desired, be positioned slightly forward of the shank area, which would allow it to cover a portion of the bullet ogive 155. This would allow a portion of the non-rigid locking band 130 and any distinctive color associated therewith to be fully visible in a loaded round of ammunition.

The 90° shoulder formed on the interior wall of the jacket 100 proximate 134/135 in conjunction with the axial length and the radial depth of the circumferential depression, coalesce to provide superior core-locking ability. The internal geometry derived from the use of a third component, i.e., an external non-rigid locking band 130, is a principle factor that provides superior bullet-core retention ability during impacts as compared with prior art bullets. However, other architectures for the circumferential depression are shown in the figures, described below, and/or contemplated by embodiments of the invention.

Figure 12:
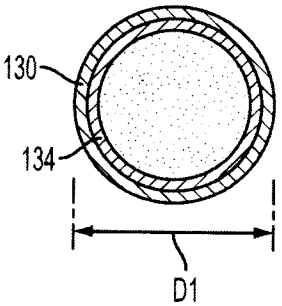
FIG. 12 is a cross-section taken at location 12 of FIG. 11.

FIG. 12 is a cross-section taken at location 12 of FIG. 11. The cross-section shows the diameter of the jacket 100 and non-rigid locking band 130 at this cross-section location 12, wherein the diameter of the jacket 100 is smaller than the diameter of the non-rigid locking band 130 at this cross sectional location 12. However, the outer diameter of the non-rigid locking band 130 is essentially similar to the outer diameter of the jacket 100 at other locations, such as portions fore 135 and aft 133 of the non-rigid locking band 130 (see FIG. 8 and FIG. 11).

Still further, the finished outside diameter of the locking band also preferably should not exceed the bore diameter, so as to avoid interference or engagement with rifling grooves of the firearm barrel. If the outside diameter of the band exceeds the bore diameter, then the rifling grooves may cut the band and cause failure or breakage in-bore or during exterior ballistic flight.

Hard barrier impact testing, such as testing to meet the FBI Gelatin Test Protocol, measures the impact of bullets against 20 gauge steel plates and windshield glass. Bullets with a non-deformable band showed impact testing results of petals breaking at the front of the band when the energy level of a particular load was too great. Bullets containing a coiled non-deformable band during testing showed the coils coming loose while traveling down the bore. There were also test results of raised appendages on the projectile at the muzzle exit, or the coils would unwind from the projectile completely.

A modification to the manufacturing approach described in FIGS. 1 through 11 above reverses the location of the bottlenecking process. More specifically, the bottlenecking process shown with respect to FIGS. 6 and 7 may be reversed, such that the diameter D1 at the base end 111 is made less than the diameter D2 at the open end 105. In that regard, the non-rigid locking band 130 may be inserted from the base end 111 of jacket 100 instead of the open end 105. All other process steps with respect to FIGS. 1 to 11 described above may be substantially the same. The advantage to this reverse bottlenecking process is that most of the forward portion of the jacket 100, which is adjacent to the open end 105, does not get work hardened, the larger open end 105 may receive the malleable core 110 more easily, and other advantages which are apparent from the description herein.

Another embodiment of the invention includes the steps of taking the standard drawn jacket 100 without the malleable core 110, forcing the jacket 100 into the bottleneck shape through the use of a bottleneck die without the malleable core 110. The non-rigid locking band 130 is attached over the jacket 100 from the open end 105 until it is positioned adjacent the larger diameter section of the jacket 100. The jacket 100 is expanded with an expander punch to expand the bottlenecked portion of the jacket 100 to increase the outside diameter thereof. The malleable core 110 is inserted therein. The malleable core 110 may then be seated as described with respect to FIGS. 1 through 11 above. The bullet point may be formed in the bullet to provide its final shape. A further alternative process can also use the reversed bottleneck approach wherein the base of the bullet jacket 100 is reduced in diameter while the open end 105 is maintained at the original diameter. The advantages being that the more pronounced radius in the closed end of the jacket 100 allows faster and more precise alignment of the non-rigid locking band 130 in a high-speed production process, and the standard diameter core and/or standard diameter seating punch may be used in a process of this nature.

Another embodiment of the invention may include point-forming the base of the jacket 100, such that it has a greatly reduced diameter. The non-rigid locking band 130 in this case may be placed on the jacket 100 base first. The insertion of the malleable core 110 is next performed on the bullet, and the malleable core 110 may be seated and manufactured consistent with FIGS. 1 through 11 above to provide the finalized bullet. The advantages of using the point-formed jacket is that the radius on the closed end of the jacket 100 allows faster and more precise alignment of the non-rigid locking band 130 in high-speed production environments, and the standard diameter core 110 and standard diameter seating punch may be used in such a process.

Figure 13:
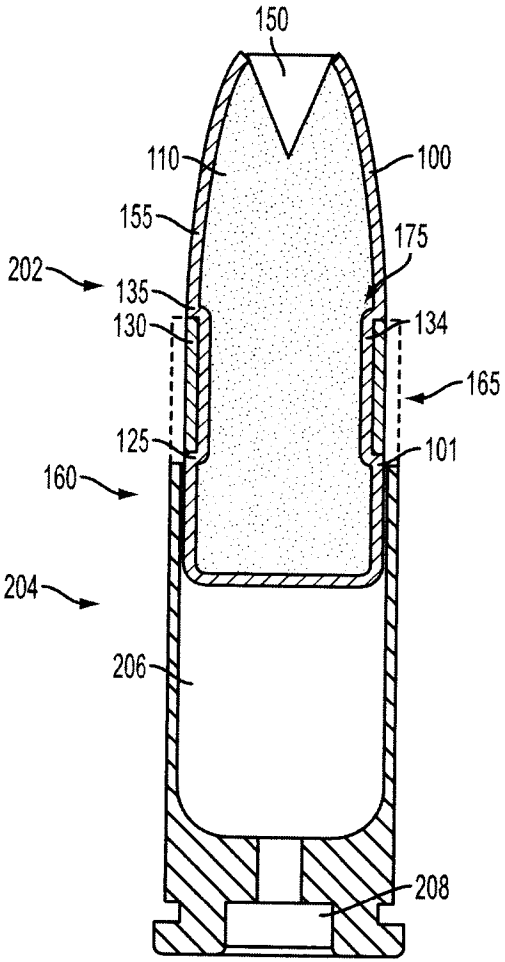
FIG. 13 is a view of a cartridge using the bullet of FIG. 11.

FIG. 13 is a view of a cartridge using the bullet 160 of FIG. 11. A round of ammunition 202 (e.g., a cartridge) for use in a firearm may be produced, using the bullet 160 configured and produced according to embodiments of the invention disclosed herein. The bullet 160 may be combined with an appropriate casing 204, propellant charge 206, flash hole (not numbered), primer pocket (not numbered), and primer 208, for example, to produce a round of ammunition. Note that the casing 204 is dashed to show that any length of the casing is contemplated by the invention. The length of casing may expose, partially cover, or fully cover the non-rigid locking band 130.

Figure 14:
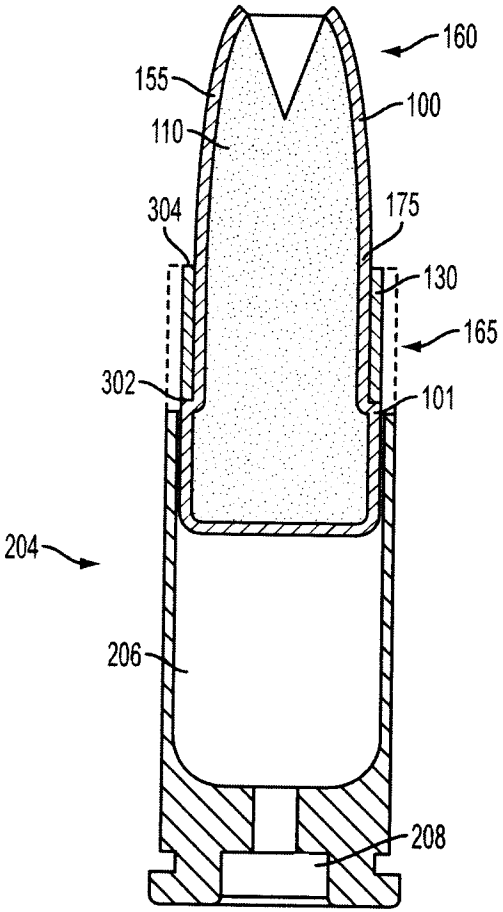
FIG. 14 is another aspect of the bullet loaded in a cartridge and configured according to embodiments of the invention.

FIG. 14 is another aspect of the bullet 160 loaded in a cartridge and configured according to embodiments of the invention. In particular, the non-rigid locking band 130 may be held to the jacket 100 through only a single indentation edge 302. In that regard, as shown in FIG. 14 the portion 304 of the bullet 160 does not have an increased radius as shown with respect to the bullet 160 of FIG. 13. Accordingly, this configuration is such that the malleable core 110 is trapped at only the base end through the edge 302.

Figure 15:
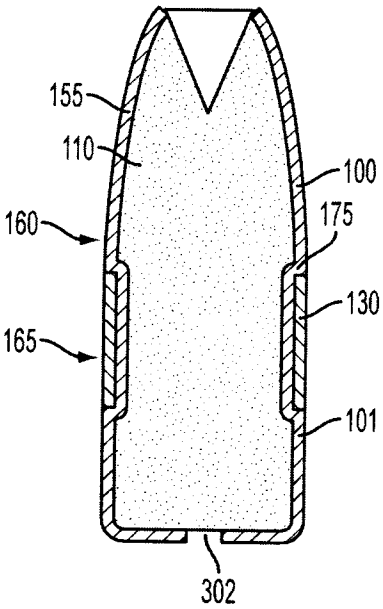
FIG. 15 is another aspect of the bullet with a perforated base configured according to embodiments of the invention.

FIG. 15 is another aspect of the bullet 160 with a perforated base configured according to embodiments of the invention. In particular, FIG. 15 shows another configuration of a bullet 160 wherein the jacket 100 of the bullet 160 includes a perforated base portion 302. The perforation 302 may be formed during the manufacturing process consistent with the processes described above. The jacket 100 shown in FIG. 15 may also be formed from metal tubing, which is open at both ends. Alternatively, the perforation 302 may be part of the original pre-formed jacket 114.

Figure 17:
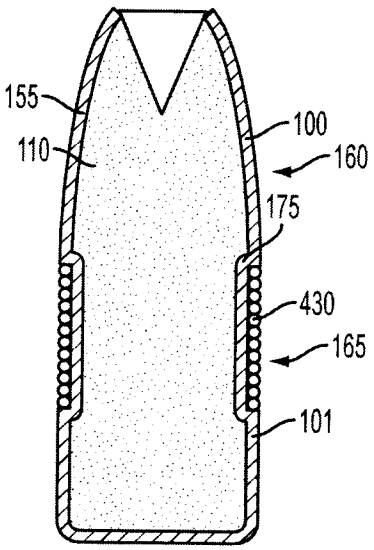
FIG. 17 is another aspect of the bullet having a helically-coiled non-rigid wire band according to embodiments of the invention.
Figure 16:
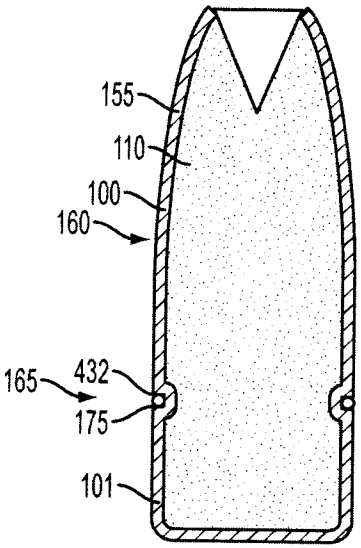
FIG. 16 is another aspect of the bullet having a non-rigid wire band configured according to embodiments of the invention.

FIG. 16 is another aspect of the bullet 160 having a non-rigid wire band configured according to embodiments of the invention. FIG. 17 is another aspect of the bullet 160 having a non-rigid wire band configured according to embodiments of the invention. In particular, FIGS. 16 and 17 show a band 432 and 430 that is formed of coiled wire. More specifically, during the manufacturing process of the bullet 160 in FIG. 16, instead of inserting a cylinder-shaped non-rigid locking band 130 during the manufacturing process described above, a single wire 432 shaped band may be used and the band may be wrapped around the bullet 160 in order to provide the same functionality as described with respect to the non-rigid locking band 130. Similarly, as shown in FIG. 17 multiple coils of wire may be attached to the bullet 160 to provide the same functionality as the non-rigid locking band 130 previously described. In either case, the wires 432 or 430 may be formed in a ring and their ends welded or the wire may be wrapped a number of times in a spiral fashion to form the coil construction. Any type of non-rigid wire arrangement to produce the wire coil 432, 430 is contemplated by embodiments of the invention.

Figure 18:
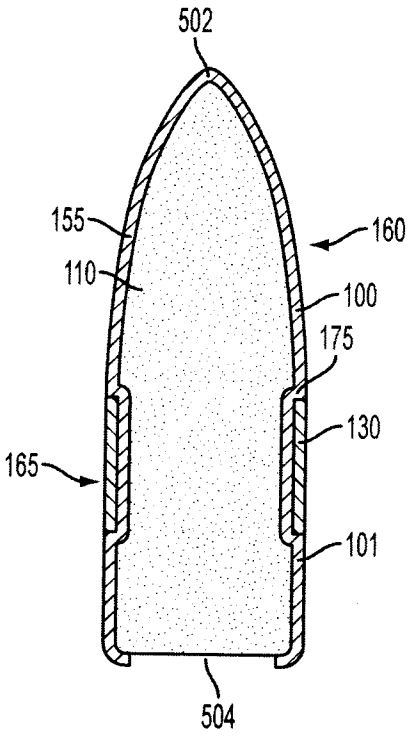
FIG. 18 is another aspect of the bullet having a closed nose configured according to embodiments of the invention.

FIG. 18 is another aspect of the bullet 160 having a closed nose configured according to embodiments of the invention. In particular, FIG. 18 shows a bullet 160 having a closed tip 502. In that regard, the jacket 100 may be constructed consistent with the process of FIGS. 1-11, except that the tip is formed from the base and is hence closed prior to performing the substantial manufacturing steps described above. Moreover, in this aspect of the invention, the base of the bullet 160 may include an open end 504. The process of manufacturing noted above can be used with this modification and is within the scope and sphere of the invention.

Figure 19:
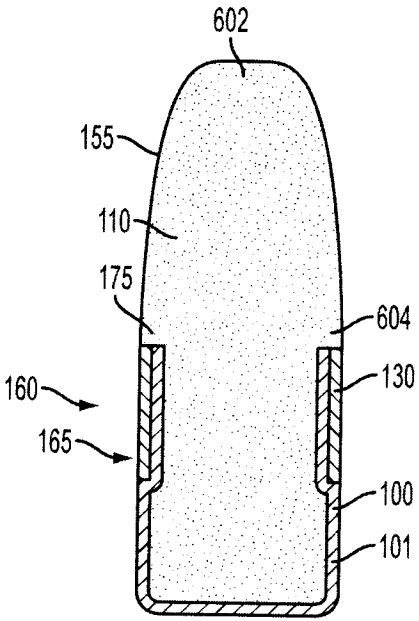
FIG. 19 is another aspect of the bullet having a lead nose configured according to embodiments of the invention.

FIG. 19 is another aspect of the bullet 160 having a lead nose configured according to embodiments of the invention. In particular, FIG. 19 shows an aspect wherein the bullet 160 has a lead nose 602 with no jacket located in this area. In this regard, the jacket 100 has a substantially reduced size and does not extend to the nose area. Moreover, the malleable core 110 may include an edge portion 604 to help maintain the jacket 100 in association with the remaining part of the malleable core 110.

As illustrated in FIGS. 11, 13-19 and 20F-20G, the bullet formed by the present invention provides for a mechanical locking connection between the jacket and core, which further defines a covered area, referred to as a "living hinge" or which hinge area/expansion control feature (indicated at 175 in FIG. 11) which allows petals of the expanding ogive portion 155 of the bullet 160 to fold outward and rearward on impact, while encountering the least possible resistance. As the locking band stretches, breaks away or is otherwise dislocated from the bullet on impact, this hinge area 175 generally is exposed, which reduces the work of expanding the bullet and expedites the rate of bullet expansion at any given velocity level, without substantially weakening the jacket 100. The expansion of the bullet about the hinge area further can provide bullets formed according to the principles of the invention with a more consistent degree and control of expansion of the bullets from round-to-round.

A significant advantage was observed in terminal performance of the non-rigid locking band in barrier testing. The FBI Gelatin Test Protocol is a collection of eight individual tests, which includes barriers that must be penetrated prior to impacting the soft test medium. Embodiments of the invention disclose a bullet and method of forming a bullet that locks the core and the jacket together in an optimum weight combination, so that deeper penetration is reached prior to expansion of the bullet. On barriers such as a steel door, the jackets can be tailored or thinned to provide a larger expansion than normal. This alteration limits over-penetration. A .40 S&W test sample multi-component bullet with core retention feature with a polymer band produced according to embodiments of the invention was tested against a variety of current bullets of the same caliber to measure penetration performance in accordance with the FBI Gelatin Test Protocol. The multi-component bullet with core retention feature 165 according to the invention scored penetration test results of 12 to 18 inches in all eight barrier tests for the FBI Gelatin Test Protocol. Table 2 below illustrates the test results for multi-component bullet with core retention feature produced by embodiments of the invention in comparison to the other bullets tested.

TABLE 2

| Bullet Type | FBI Barrier Test Score |
|---|---|
| Brass jacketed hollow point with polymer band | 376 |
| Non-bonded GS40SWA | 317 |
| Bonded 53970 | 307 |
| Bonded GSB40SWA | 299 |
| Non-bonded P40HST3 | 224 |
| Non-bonded RA40TA | 173 |
| Bonded LE40T3 | 53 |

Figure 20G:
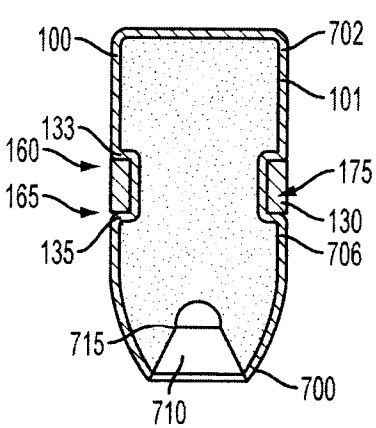

FIGS. 20A-20G illustrate still a further embodiment of a method of manufacturing the multi-component bullet 160 with a core retention feature 165. FIG. 20A illustrates a cylindrical metal jacket 100, which may be formed from any suitable malleable material, such as brass, yielding metal, copper, mild steel, etc., as discussed above. As indicated at FIG. 20B, in a first step, the jacket 100 will undergo a bottlenecking operation, defining a first or upper end 700, which is necked down or tapered along an area 701 to a reduced diameter lower or second portion 702. Thereafter, the malleable core 110 will be inserted into the bottlenecked jacket 100, as indicated in FIG. 20C. The malleable core 110 generally is press fitted into the jacket and generally is conformed to the shape of the bottlenecked jacket as FIG. 20C illustrates, such as by a punch or similar tool pressing in the direction of arrow 138, with a portion of the jacket remaining unfilled, thus resulting in an upper open space, indicated at 704 in FIGS. 20C and 20D, between the end of the malleable core 110 and the open upper end 105 of the jacket 100.

As illustrated in FIG. 20D, in a next step, the non-rigid locking band 130 will be inserted or placed about the jacket adjacent the tapered section 701 (FIG. 20C). The non-rigid locking band can be extruded or injection molded about the jacket, with the jacket being held in a die or fixture, or can be wrapped thereabout and its ends sealed or otherwise attached so as to encircle the jacket. An injection molded polymer needs to flow without forming pronounced weld lines in the finished part. Weld lines can be a source of breakage points during manufacturing. A polymer is also subjected to tensile and compressive forces during manufacturing, which can lead to "feathering" at the ends of the band. Different polymers have a wide variety of appearances after being worked during manufacturing, which needs to be taken into account.

The jacket, with the non-rigid locking band formed or applied thereabout will further undergo a first forming operation, as indicated in FIG. 20D, wherein the malleable core is subjected to compression, such as by a seating punch or similar tool as the non-rigid locking band is held in a clamped or secured position about the jacket. As a result, as the malleable core is urged or compressed further downwardly into the jacket, the bottom or lower or second portion 702 of the jacket is generally caused to expand outwardly. This outward expansion of the jacket causes the jacket and malleable core to thus be expanded around the non-rigid locking band 130, as shown in FIG. 20D, creating the circumferential depression or protrusion 134. This serves to form a mechanical locking connection between the jacket and the malleable core to help retain the jacket and malleable core together even after impact, with the non-rigid locking band further being engaged by the edges or shoulder portions 706 of the fore and aft portions 135 and 133 of the jacket defining the circumferential depression.

Figure 20F:
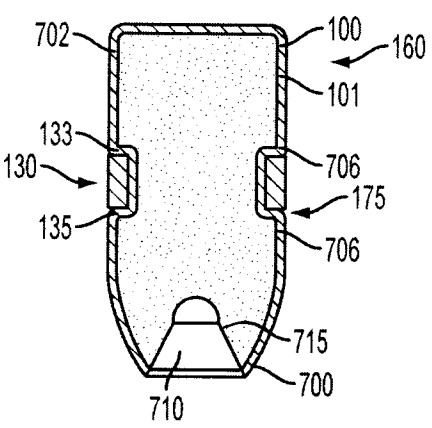
Figure 20E:
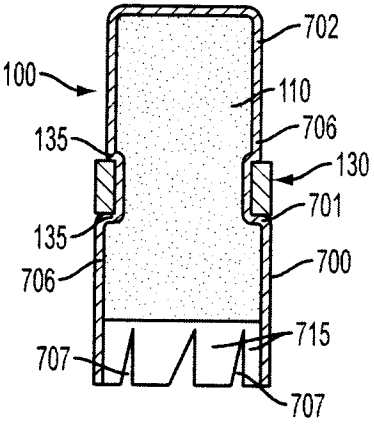

As illustrated in FIG. 20E, after undergoing the initial or first forming step shown in FIG. 20D, the bullet is reoriented approximately 180° so that its second portion 702 is now arranged in an upward facing direction, while the first portion 700 is oriented downwardly. The open end 105 of the bullet 160 is thereafter subjected to cutting so as to form a series of nose cuts 707 therein to facilitate folding the spaced portion of the jacket inwardly and about the malleable core so as to form a cavity or recessed opening 710, as indicated in FIG. 20F, and which will help to define petals 715 that fold rearwardly and outwardly upon impact of the bullet.

Following the formation of the nose cuts 707 in the jacket, the jacket and malleable core are subjected to a secondary or further forming operation, wherein the nose cut sections 707 of the jacket are folded inwardly, thus forming the nose opening or recess 710 of the bullet 160 as shown in FIGS. 20F and 20G. As a further result of the secondary forming operation, the bullet is further compacted, causing the overall height or length of the bullet to be reduced, while at the same time, causing the malleable core and jacket to further expand outwardly.

Thereafter, as needed, the bullet 160 can undergo a further resizing operation, as indicated in FIG. 20G, in which the bullet is subjected to additional forming operations so as to resize and form the bullet with a substantially smooth side profile configuration, wherein the outer diameter of the non-rigid locking band is substantially equal to the outer diameter of the jacket. As a result, as is generally indicated in FIG. 20G, the outer surface or edge of the non-rigid locking band is thus substantially flush with the sides of the bullet 160 so that during firing, the non-rigid locking band will be maintained out of engagement with the rifling grooves of the barrel of the firearm, which rifling grooves can engage and cut or otherwise cause damage to the non-rigid locking band. As a further result of the secondary forming operation and/or the resizing operation, the living hinge or hinge area/expansion control feature 175 of the bullet 160 is created within the bullet, with this hinge area being covered and protected during firing of the bullet and upon initial impact as the non-rigid locking band is broken away, stretched or otherwise dislocated or dislodged from the bullet following impact, whereupon the expansion of the petals 715 of the bullet, created by the separation and expansion of the ogive portion 155 of the bullet, such as along the nose cut lines is facilitated and controlled to prevent over-expansion and/or separation of the core and jacket during impact.

While the invention has been described in terms of exemplary embodiments, those skilled in the art will recognize that the invention can be practiced with modifications in the spirit and scope of the appended claims. The examples given above are merely illustrative and are not meant to be an exhaustive list of all possible designs, embodiments, applications, or modifications of the invention.

What is claimed is:

1. A bullet, comprising:

a malleable core having a section with a first end and a second end;

a jacket surrounding the malleable core, the jacket having a first end and a second end; and a non-rigid locking band surrounding a portion of the jacket configured to retain the malleable core with the jacket during use, at least a portion of the locking band extending along a circumferential depression in a wall of the jacket and the malleable core;

wherein the locking band comprises a deformable material such that upon impact, the locking band moves away from the circumferential depression, exposing a hinge area defined adjacent the circumferential depression and about which at least a portion of the jacket folds during expansion of the bullet.

2. The bullet of claim 1, wherein the locking band comprises a plastic material having a reduced weight such that a combined weight of the jacket and the locking band does not exceed 25% of a total bullet weight.

3. The bullet of claim 2, wherein the locking band comprises a filled or unfilled thermoplastic polymer material.

4. The bullet of claim 3, wherein the polymer material of the locking band further includes at least one of a reinforcing material comprising approximately 20% to 40% carbon fiber, a hardness range of approximately 95-114 on the Rockwell M scale, or a melting temperature of at least approximately 400° F. or higher.

5. The bullet of claim 2, wherein the polymer material of the non-rigid locking band further comprises approximately 0.25%-5.0% of a lubricant.

6. The bullet of claim 1, wherein the locking band comprises a polymer material selected from the group comprising: Polycarbonate, polyetherimide, poly ether ketone, poly phenylene sulfides and oxides, high density polyethylene, polystyrene, polyoxymethylene, and polyamide materials.

7. The bullet of claim 1, wherein the non-rigid locking band comprises an outside diameter that is equal to or less than an outside diameter of an outermost portion of the bullet.

8. The bullet of claim 1, wherein the malleable core further comprises a centrally aligned recess formed in the first end of the malleable core.

9. The bullet of claim 1, wherein an outside diameter of the locking band is substantially equal to or less than an outside diameter of the jacket.

10. The bullet of claim 1, wherein the locking band has an axial wall height of about 0.075-0.125 inches.

11. The bullet of claim 1, the jacket further comprising a jacket weakening feature adjacent the first end of the jacket.

12. The bullet of claim 11, wherein the jacket weakening feature comprises a plurality of longitudinally projecting spaced slits forming a plurality of spaced petals.

13. The bullet of claim 1, wherein the locking band comprises a metal material, and further comprises a series of weakened areas formed at spaced locations about a circumference of the locking band.

14. A method of manufacturing a bullet, comprising:

filling a jacket with a core material;

applying a non-rigid, deformable band about the jacket;

forming a circumferential depression about the jacket and the core material within the jacket with the non-rigid band being received within the circumferential depression formed in the jacket and the malleable core; and expanding the core material and jacket adjacent the circumferential depression such that the jacket and the malleable core material are retained together with the non-rigid band positioned within the circumferential depression formed around the jacket;

wherein forming the circumferential depression comprises urging portions of the jacket and malleable core inwardly to define a hinge area at a selected location along the body of the bullet below an ogive portion thereof, whereby upon impact of the bullet, the ogive portion of the bullet folds about the hinge area to facilitate expansion of the bullet.

15. The method of claim 14, further comprising:

radially expanding the jacket and the malleable core material to form shoulder areas in the jacket adjacent first and second end edges of the non-rigid locking band received within the circumferential depression.

16. The method of claim 14, further comprising:

configuring jacket-weakening features in an open end of the jacket.

17. The method of claim 14, wherein applying a non-rigid deformable band about the jacket comprises injection molding a polymer material locking band at an intermediate location along a length of the jacket.

* * * * *